US006857406B2

(12) United States Patent
Matsuura et al.

(10) Patent No.: US 6,857,406 B2
(45) Date of Patent: Feb. 22, 2005

(54) VALVE DRIVING DEVICE FOR AN ENGINE

(75) Inventors: Hirokazu Matsuura, Aki-gun (JP); Kouji Asanomi, Aki-gun (JP); Toshiaki Nishimoto, Aki-gun (JP); Taketoshi Yamauchi, Aki-gun (JP)

(73) Assignee: Mazda Motor Corporation, Hiroshima (JP)

( * ) Notice: Subject to any disclaimer, the term of this patent is extended or adjusted under 35 U.S.C. 154(b) by 74 days.

(21) Appl. No.: 10/668,597

(22) Filed: Sep. 24, 2003

(65) Prior Publication Data

US 2004/0112313 A1 Jun. 17, 2004

(30) Foreign Application Priority Data

Sep. 30, 2002 (JP) ..... 2002-288132

(51) Int. Cl.[7] ..... F01L 1/14

(52) U.S. Cl. ..... 123/90.48; 123/90.16; 123/90.39; 123/90.44; 123/90.6

(58) Field of Search ..... 123/90.16, 90.17, 123/90.18, 90.39, 90.44, 90.48, 90.52, 90.55, 90.6, 567, 569

(56) References Cited

U.S. PATENT DOCUMENTS 5,651,335 A * 7/1997 Elendt et al. ..... 123/90.16
6,223,706 B1 * 5/2001 Maas et al. ..... 123/90.16
6,397,804 B1 * 6/2002 Harada et al. ..... 123/90.16
6,457,445 B1 * 10/2002 Sugawara ..... 123/90.16
6,470,840 B1 10/2002 Ebesu et al.

FOREIGN PATENT DOCUMENTS

JP 2001-329907 11/2001
JP 2002-54413 2/2002

* cited by examiner

*Primary Examiner*—Thomas Denion
*Assistant Examiner*—Ching Chang
(74) *Attorney, Agent, or Firm*—Nixon Peabody LLP; Donald R. Studebaker

(57) ABSTRACT

A valve driving device including a tappet assembly adapted to slide in a tappet guide hole to drive a valve and including a high-speed center tappet and low-speed side tappet; and a high-speed center cam and a low-speed side cam provided corresponding to the center tappet and the side tappet. A depression is formed which is depressed from a base circle to roughly the same profile as a shaft section of the camshaft so that the cam portion over a predetermined angle range where a cam nose section is not formed in the centrally located center cam is smaller than the base circles of the outside located side cams in profile.

9 Claims, 6 Drawing Sheets

VALVE DRIVING DEVICE FOR AN ENGINE

FIELD OF THE INVENTION

The present invention relates to a valve driving device for an engine, more particularly to a valve driving device for an engine comprising a tappet which includes a high-speed tappet and a low-speed tappet slidably received in a tappet guide hole while abutting a cam so as to drive a valve.

DESCRIPTION OF THE RELATED ART

Conventionally, a direct-type valve driving device is known which directly drives an intake valve and an exhaust valve of an engine of an automobile or the like via a tappet (refer to Japanese Unexamined Patent Publication No. 2001-329907 (U.S. Pat. No. 6,470,840 B2) and Japanese Unexamined Patent Publication No. 2002-54413 (U.S. Pat. No. 6,397,804 B1)). The device includes a tappet assembly comprising a center tappet and side tappets arranged on both sides of the center tappet with respect to an axial direction of the cam. Both side tappets are connected with each other by a connecting portion extending perpendicular to both side tappets in the vicinity of their valve-side ends. On an opposite surface to the cam of the connecting portion, an abutment is provided which abuts on a valve stem. The center tappet is interposed between both the side tappets slidably with respect to the side tappets so as to form a columnar periphery, as a whole. The center tappet and the side tappets are connected with, and disconnected from, each other via a lock mechanism. The lock mechanism performs a connecting operation, or disconnecting operation, so as to change a valve characteristic in cooperation with a center cam and side cam different from each other in cam profile.

In the case of the camshaft adjacently formed with the cams different in cam profile corresponding to the separate-type tappet as described above, the adjacent cams are closely arranged. This may prevent a smooth metal flow in a casting process for the camshaft. Particularly, in the case of three cams provided for one tappet and two intake valves and two exhaust valves arranged for one cylinder, the diameter of the tappet is relatively smaller, which may significantly limit the clearance between the cams along the axial direction of the camshaft.

SUMMARY OF THE INVENTION

In view of the above-described problem, an object of the present invention is to improve the metal flow in a casting process for a camshaft which is to be used for a valve driving device for an engine and is provided with one high-speed cam and two low-speed cams corresponding to one tappet assembly including a high-speed tappet and low-speed tappets, respectively.

In accordance with the present invention, there is provided a valve driving device for an engine. The valve driving device comprises a camshaft and a tappet assembly. The camshaft is produced by casting and formed with one center cam and two side cams which are different from the center cam in lift amount, in such a manner that the center cam is centrally located between the side cams in the axial direction of the camshaft. The tappet assembly is slidably fitted in a tappet guide hole formed in the engine while abutting on one of the center cam and the side cams to drive a valve, and includes a center tappet adapted to abut on the center cam and side tappets adapted to abut on the side cams. The center is supported to the side tappets slidably with respect to the side tappets in the sliding direction of the tappet. One of the center tappet and the side tappets is connected to a valve shaft of the valve. The valve driving device further includes a lock mechanism that selectively locks or unlocks the center tappet and the side tappets with or from each other so that the tappet is driven by the center cam when the lock mechanism locks the center tappet and the side tappets with each other, and the tappet assembly is driven by the side cams when the lock mechanism unlocks the center tappet and the side tappets from each other. One cam of the center cam and the side cams is dimensioned so that a cam portion thereof over a predetermined angle range except for a cam nose section thereof is smaller than a base circle of the other cam in profile.

The cam nose sections of the center cam and the side cam are essential to selectively achieve a high-speed engine operation or a low-speed engine operation. However, base circles of both the cams similarly affect the valve operation characteristic. Thus, as for the base circles, only one of the center cam and side cams yields the proper valve operation characteristic. Therefore, one of the cams can be dimensioned so that a cam portion over a predetermined angle range except for a cam nose section is smaller than a base circle of the other cam in profile. This allows molten metal to smoothly fill between the cams in a casting process for the camshaft, in other words, improves metal flow, while attaining a lightweight camshaft.

Preferably, a depression may be formed over the predetermined angle range except for the cam nose section of the one cam, the depression being depressed from the base circle of the one cam so as to be substantially the same as a shaft section of the camshaft in profile.

In the case that the base circles of the center cam and the side cams similarly affect the valve operation, a cam portion except for the cam nose section can be depressed at most so as to be substantially the same as a shaft section of the camshaft in profile, without any disadvantage in the valve operation characteristic or rigidity of the camshaft. This design improves metal flow to the fullest extent.

More preferably, the two side cams are identical in cam profile and lower than the center cam in lift amount, and the one cam is the center cam.

Accordingly, the base circles of the side cams are free from a depression, so that the distance can be measured between the only base circle surface of the side cam and a reference surface of the tappet, thereby easing in adjustment of a tappet clearance. This is because, in the case of no depression in the center cam, the distances should be measured between the base circle surface of the center cam, and between the base circle surface of the side cam (or at least two measurements are required) in the adjustment of the tappet clearance. Additionally, the center cam and the side cams should be separately subjected to the grinding process because of the difference in their cam profiles. The base circle section of the center can is formed with the depression with no need for accurate grinding, which simplifies the production process of the camshaft.

Further preferably, the portion over the predetermined angle range may be left as-cast, because the portion does not function as a cam. This simplifies the manufacturing process of the camshaft.

As for the tappet, the tappet may preferably include a lost-motion spring biasing the center tappet towards the center cam, and the side tappet may preferably include a limiting portion which limits the displacement of the center tappet against the biasing force of the lost-motion spring so as to prohibit an abutting surface of the center tappet on the center cam from shifting beyond abutting surfaces of the side tappets on the side cams.

Accordingly, with the lost-motion spring which biases the center tappet, the center tappet is stably supported in such a way that the center tappet is biased towards the center cam until the displacement has been limited by the limiting portion. This prevents the center tappet from rattling even with the depression formed in the center cam, or even with the clearance left between the center cam and the center tappet.

Preferably, the limiting portion may be formed by use of the lock mechanism. Particularly, the lock mechanism may include a hydraulic piston and a lock pin received in bushings fitted in through holes formed in the center tappet and the side tappets, the lock pin may be driven by the hydraulic piston, and the bushing in the side tappet may protrude towards the center tappet so as to abut on the center tappet to limit the displacement of the center tappet.

More preferably, the side tappets may be connected with each other via a connecting portion provided at the ends opposite to the abutting surfaces to form substantially U-shape when viewed in the direction perpendicular to the sliding direction of the tappet and in the direction perpendicular to the axial direction of the camshaft. The connecting portion may abut the valve shaft, and the tappet assembly may be of a substantially circular shape formed by the center tappet and the side tappet when viewed in the sliding direction of the tappet.

In the case of the tappet assembly having a circular shape when viewed in the sliding direction of the tappet, the center cam and the side cams should be closely arranged in the camshaft, which may more possibly cause the problem of the degradation in molten flow. However, forming the depression in the cam advantageously solves the problem.

Also, the center tappet may have a substantially rectangular shape, elongated in the direction perpendicular to the axial direction of the camshaft when viewed in the sliding direction of the tappet. Projections may be formed at both end surfaces of the center tappet with respect to the direction perpendicular to the axial direction of the camshaft and perpendicular to the sliding direction of the tappet, so as to project towards the side tappets. Inner surfaces of the projections may form sliding surfaces which extend in the sliding direction of the tappet and slidably contact with the side tappets. The side tappets may have a substantially bicornate shape when viewed in the sliding direction of the tappet, and sliding surfaces may be formed at both ends of the side tappets with respect to the direction perpendicular to the axial direction of the camshaft and perpendicular to the sliding direction of the tappet, so as to extend in the axial direction of the camshaft and in the sliding direction of the tappet and to slidably contact with the inner surfaces of the projections.

Accordingly, the edge portions of bicornate side tappets are in the sliding surfaces and covered by the projection formed in the center tappet along the sliding direction of the tappet. This avoids wear to the inner surface of the tappet guide hole due to the acute edges which would be formed in the case without the above sliding surfaces or the projections.

Other features, aspects, and advantages of the present invention will become apparent from the following description of the invention which refer to the accompanying drawings.

BRIEF DESCRIPTION OF THE DRAWINGS

FIG. 1(*b*) is a partial plan view of a cam;

DETAILED DESCRIPTION OF THE INVENTION

A preferred embodiment of the present invention will now be described with reference to the drawings.

Figure 1:
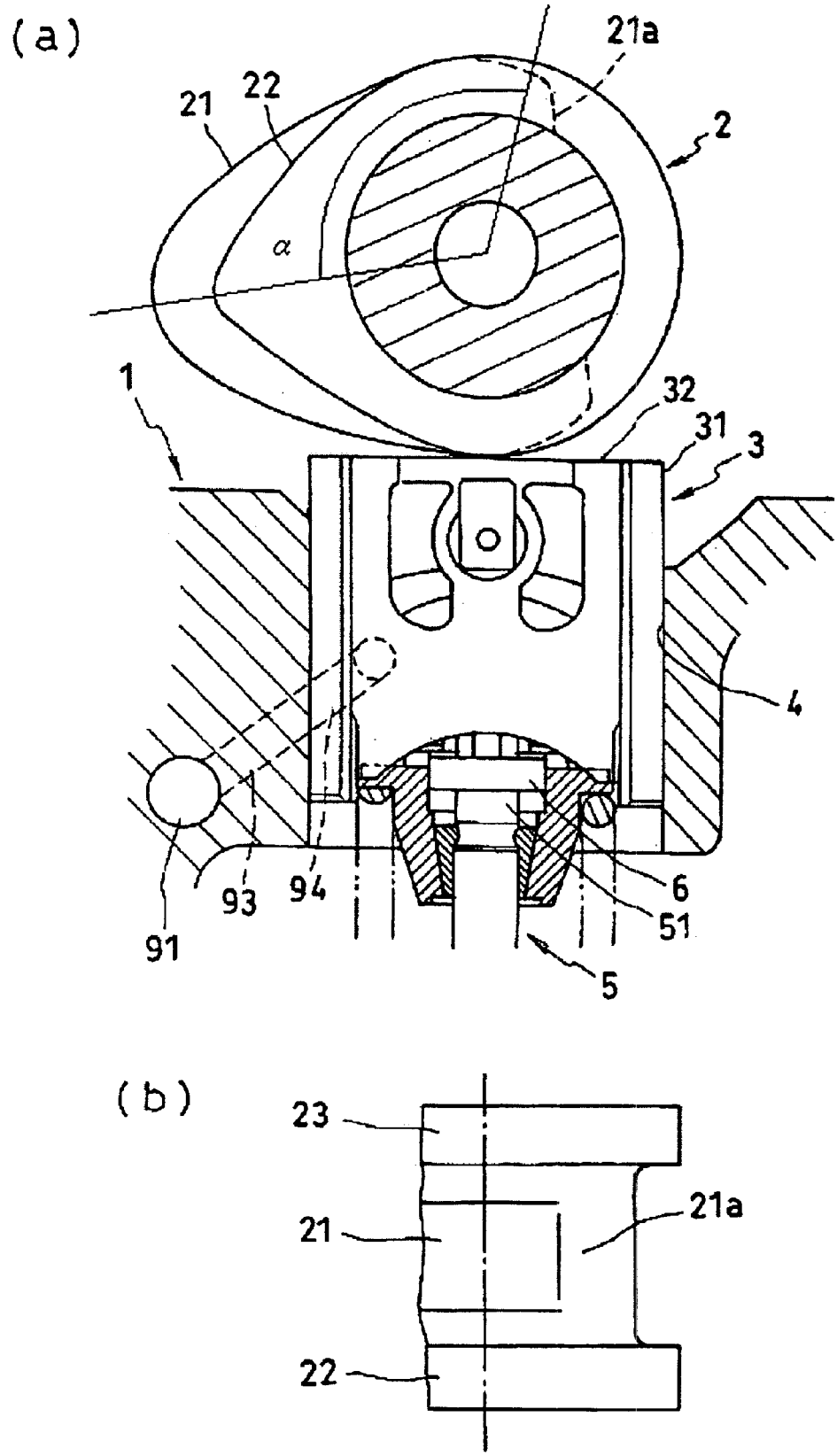
FIG. 1(*a*) is an elevational view of a main portion of the valve driving device in accordance with the preferred embodiment of the present invention, partly showing a cross-section taken along a line perpendicular to a camshaft axis.
Figure 2:
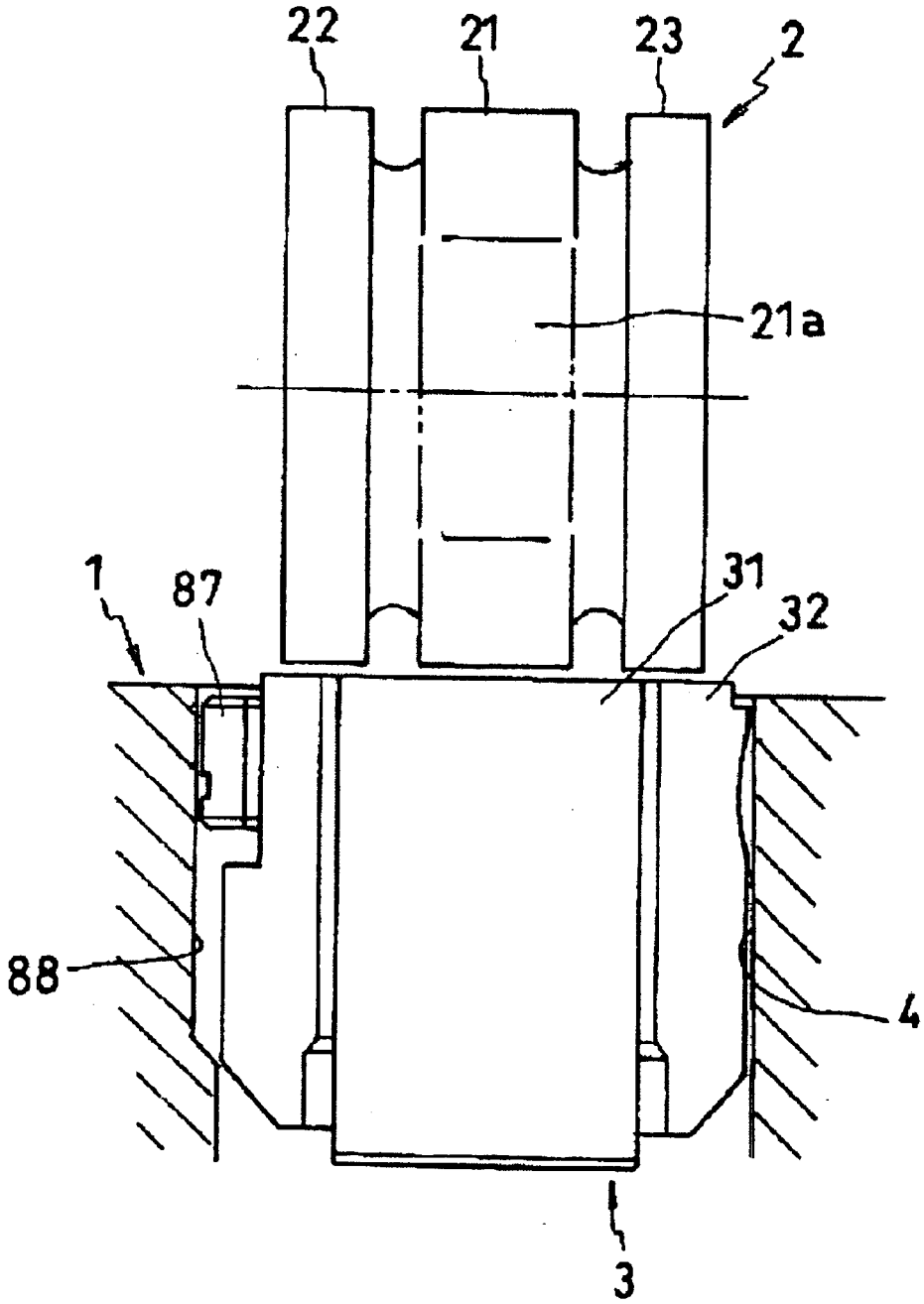
FIG. 2 is a side view of a main portion of the valve driving device in accordance with the preferred embodiment of the present invention, partly showing a cross-section taken along a line in parallel with the camshaft axis.
Figure 3:
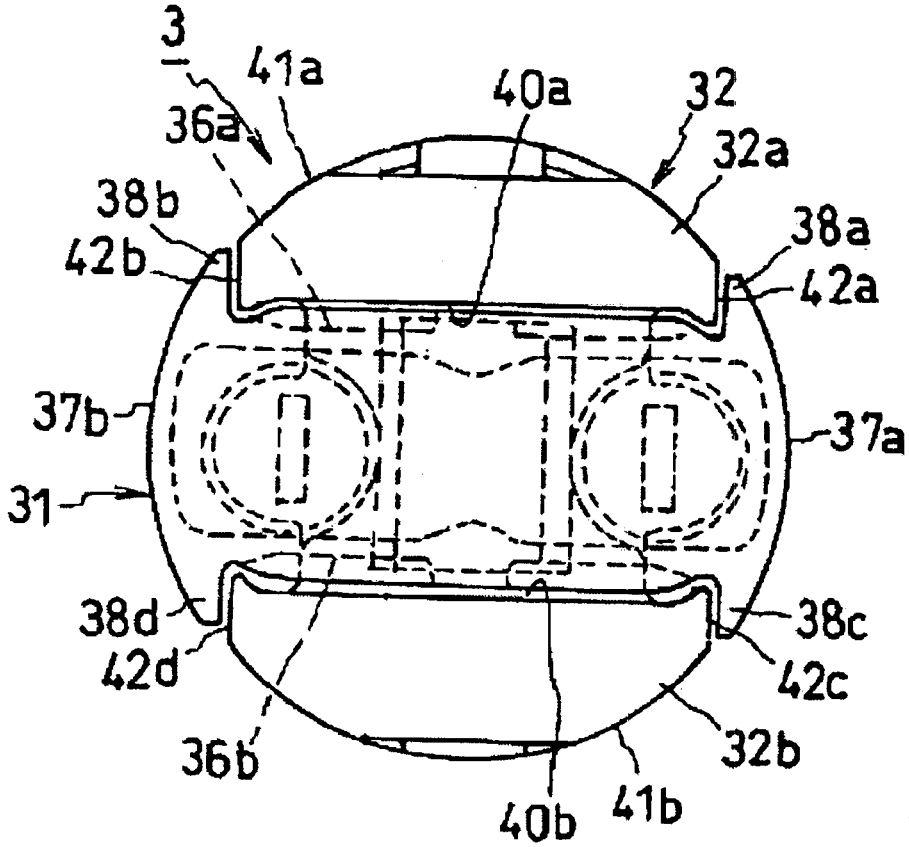
FIG. 3 is a plan view of a tappet in accordance with the preferred embodiment of the present invention.
Figure 4:
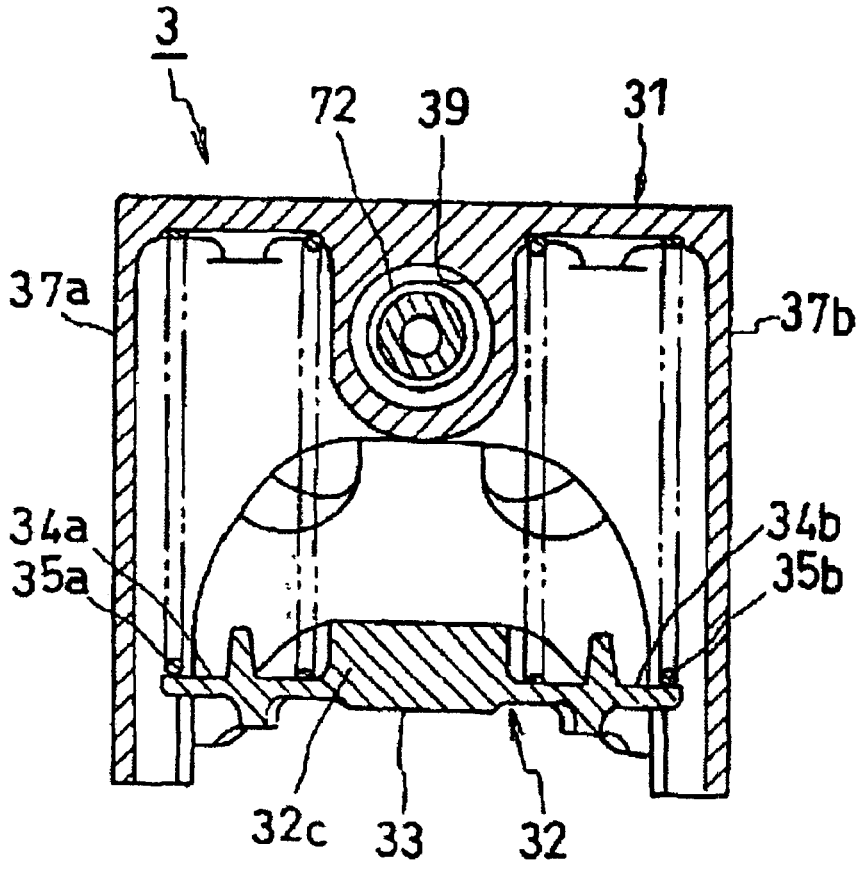
FIG. 4 is an elevational cross-sectional view of the tappet in accordance with the preferred embodiment of the present invention taken along a line passing through the center of the tappet perpendicular to the camshaft axis.

In FIG. 1 and FIG. 2, identified by the reference numeral 1 is a cam carrier disposed at the upper portion of a cylinder head (not shown) of the engine, 2 is a camshaft, 3 is a tappet assembly, 4 is a tappet guide hole formed in the cam carrier 1, and 5 is a valve (intake valve or exhaust valve). As shown in FIGS. 3 to 6, the tappet assembly 3 comprises a high-speed center tappet 31 (high-speed tappet) and a low-speed side tappet 32 (low-speed tappet). In association with the tappet assembly 3, a camshaft 2 is formed with a high-speed center cam 21 (high-peed cam) and low-speed side cams 22, 23 (low-speed cam). The center cam 21 is located corresponding to the center tappet 31 and has a high lift profile with high cam nose, which provides high valve lift. The side cams 22, 23, on both the side of the center cam 21, are located corresponding to the side tappet 32 and have a low lift profile with lower cam nose than that of the center cam 21, which provides low valve lift. The side cams 22, 23 on both the sides are identical in cam profile. Alternatively, in an engine with two intake valves for respective cylinders, the side cams 22, 23 on both sides may be deactivation cams identical in cam profile for deactivating one of the two valves during low-speed and low-load operation of the engine. When the engine is of a so-called direct injection engine, the deactivation cams may be in circular without a cam nose section, for the deactivation of the valves. As for a so-called port injection engine equipped with a fuel injector in an intake port, in order to prevent the fuel deposition in the intake port during the valve deactivation, the deactivation cams may have a profile with a small amount of lift that allows the valve to slightly open.

As shown in FIG. 1 and FIG. 2, the camshaft of the valve driving device is originally designed so as to include a depression 21*a* The depression 21*a* is formed at a portion over a predetermined angle range where the cam nose section is not formed in the centrally located high-speed center cam 21. The depression 21*a* is depressed from the base circle of the center cam 21 so as to be smaller than the base circle of the low-speed side cams 22, 23 in profile and roughly the same as a shaft section of the center cam 21 in profile. The camshaft 2 is formed by casting, and the depression 21*a* is left as-cast. In other words, the depression 21*a* is formed in the very casting process by which the camshaft 2 is manufactured.

The predetermined angle range depends on the cam profile, particularly, the angle range where the cam nose is formed. As for the form of the depression, the depression may preferably formed so as to gradually recede at the transition portion from the cam-nose section to the base circle section and then steeply recede as the angle ($\alpha$) from the cam-nose section increases.

The tappet assembly 3 is columnar shaped, as a whole, with the center tappet 31 centrally located with respect to the camshaft axis (central axis of the camshaft 2), and the side tappet bodies 32*a*, 32*b* of the side tappet 32 flanking the center tappet 31. An upper surface of the center tappet 31 comprises a center cam abutting face in roughly rectangular and planar shape elongated in the cam-sliding direction (the direction perpendicular to the camshaft axis in a top plan view). Upper surfaces of both the side tappet bodies 32*a*, 32*b* of the side tappet 32 comprise side cam abutting faces in roughly bicornate and planar shape which flank the center cam abutting face to form a circular cam abutting face as a whole.

Figure 5:
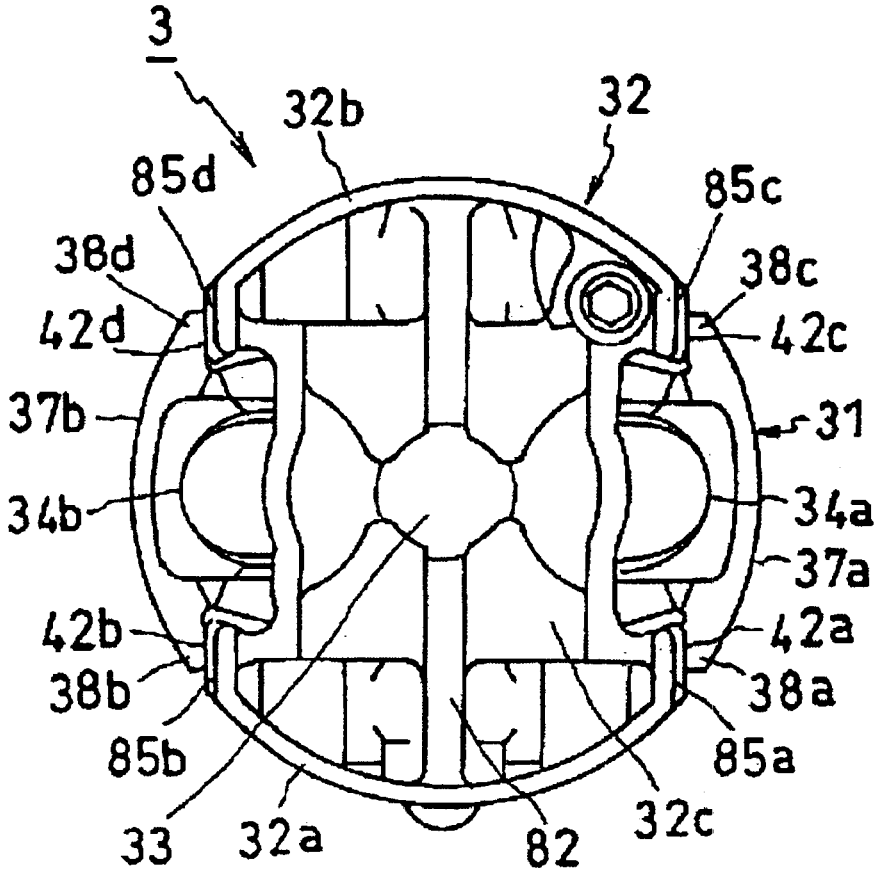
FIG. 5 is a side cross-sectional view of the tappet in accordance with the preferred embodiment of the present invention taken along a line passing through the center of the tappet in parallel with the camshaft axis.
Figure 6:
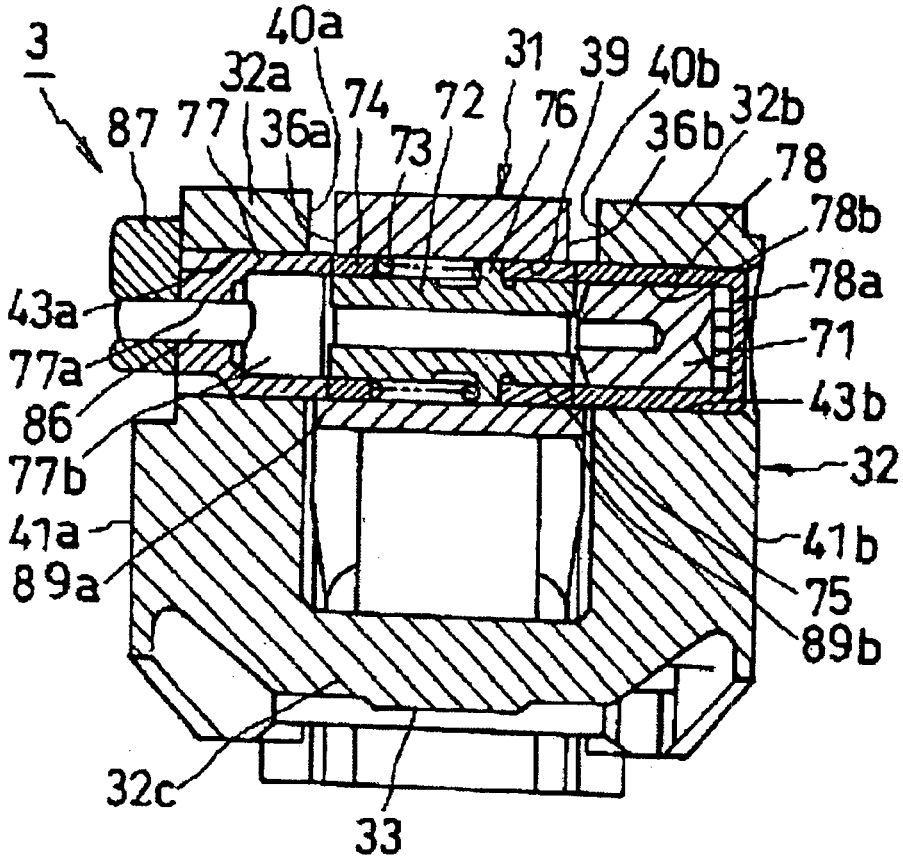
FIG. 6 is an elevational cross-sectional view of the tappet in accordance with the preferred embodiment of the present invention taken along a line passing through the center of a lock mechanism for the tappet.

The side tappet 32, roughly U-shaped when viewed from the side is constituted by integrally connecting the side tappet bodies 32*a*, 32*b* forming the side cam abutting face with each other via a connecting portion 32*c*. The connecting portion 32*c* connects the side tappet bodies 32*a*, 32*b* in the vicinity of an opposite end to the cam abutting face (referred to as opposite side). The connecting portion 32*c* is provided with an abutting portion 33, which abuts a valve stem end 51, on its lower surface (refer to FIG. 1). The connecting portion 32*c* is also provided with lost-motion spring seats 34*a*, 34*b* at both ends in the direction perpendicular to the camshaft axis. With lost-motion springs 35*a*, 35*b* placed on the respective lost-motion spring seats 34*a*, 34*b*, the center tappet 31 is interposed into both the side tappet bodies 32*a*, 32*b*. The lost-motion springs 35*a*, 35*b* are coil compression springs. The tappet assembly 3 abuts the stem end 51 of the valve 5 in such a way that the abutting portion 33 on the lower surface of the connecting portion 32*c* of the side tappet 32 contacts the shim 6, and the shim 6, in turn, contacts the stem end 51. Additionally, as shown in FIG. 5, a rib 82 is formed in the connecting portion 33. The rib 82 reinforces the side tappet 32 so as to prevent the expansion of the distance between both the side portions of the tappet 32 in U-shape, thereby avoiding an increase in sliding friction between the outer surface of the side tappet 32 and the inner surface of the tappet guide hole 4.

The center tappet 31 is formed with a pair of end faces 36*a*, 36*b*. The end faces 36*a*, 36*b* extend downwardly and symmetrically in the direction of movement, from edges on the sides oriented in parallel with the cam-sliding direction (both longer sides of the rectangular plane) in the center cam abutting face in roughly rectangular and planar shape. The center tappet 31 is also formed with a pair of peripheral surfaces 37*a*, 37*b* having an arc cross-section. The peripheral surfaces 37*a*, 37*b* extend downwardly and symmetrically in the right and left direction, from edges on the sides oriented perpendicular to the camshaft axis (both shorter sides of the rectangular plane). At both ends in the direction perpendicular to the camshaft axis, projections 38*a*, 38*b*, 38*c*, 38*d* are formed. The projections 38*a*, 38*b*, 38*c*, 38*d* are formed over the length along the tappet axis so as to project perpendicularly from end faces 36*a*, 36*b* in the camshaft axis direction, thereby forming roughly I-shape of the center tappet as a whole in a top plan view. The outer faces of the projections 38*a*, 38*b*, 38*c*, 38*d* project towards the side tappet 32 (side tappet bodies 32*a*, 32*b*) so as to continue from the peripheral surfaces 37*a*, 37*b* in an arc-like shape. The inner faces of the projections 38*a*, 38*b*, 38*c*, 38*d* comprise sliding surfaces. The sliding surfaces extend in the tappet axis direction and in parallel with the camshaft axis, and oppose to each other in the direction perpendicular to the camshaft axis. At the central upper portion of the center tappet 31, a through hole 39 is bored which passes across end faces 36*a*, 36*b* in parallel with the camshaft axis.

The side tappet 32 is in roughly U-shape in a side view as described above. The side tappet 32 comprises a pair of inner edge faces 40*a*, 40*b* downwardly and oppositely extending at the inside of the pair of the right and left side tappet bodies 32*a*, 32*b*. The side tappet 32 also comprises outer surfaces 41*a*, 41*b* with an arc cross-section. The outer surfaces 41*a*, 41*b* extend downwardly and symmetrically in the direction of movement, from the outer edges of the side cam abutting faces with respect to the camshaft axis direction. At both opposite ends in the cam-sliding direction (the direction perpendicular to the camshaft axis) of the respective side tappet bodies 32*a*, 32*b*, sliding-contact portions 42*a*, 42*b*, 42*c*, 42*d* are formed. The sliding-contact portions 42*a*, 42*b*, 42*c*, 42*d* include sliding surfaces which extend in the tappet axis direction and in parallel with the camshaft axis direction. The sliding-contact portions 42*a*, 42*b*, 42*c*, 42*d* are brought into sliding contact with sliding surfaces of the projections 38*a*, 38*b*, 38*c*, 38*d* of the center tappet 31. At the upper central portions of the side tappet bodies 32*a*, 32*b* of the side tappet 32, through holes 43*a*, 43*b* are bored (see FIG. 5 for example). The through holes 43*a*, 43*b* pass from the respective inner edge faces 40*a*, 40*b* to the outer surfaces 41*a*, 41*b*. The through holes 43*a*, 43*b* are in smooth and communicative alignment with the through hole 39 of the center tappet 31 when the center cam abutting face of the center tappet 31 and the side cam abutting faces of the side tappet 32 align with each other.

The center tappet 31 and the side tappet 32 are positioned so that the center cam abutting face of the center tappet 31 and the side cam abutting faces of the side tappet 32 align with each other when the side cam abutting faces of the side tappet 32 are in contact with the base circles of the side cams 22, 23. In this state, the through hole 39 of the center tappet 31 and the through holes 43*a*, 43*b* of the side tappet 32 are in communicative alignment with each other.

In the through hole 43*b* of side tappet body 32*b* of the side tappet 32, a hydraulic plunger 71 is embedded. The hydraulic plunger 71 is capable of plunging into the through hole 39 of the center tappet 31 under hydraulic pressure. In the through hole 39 passing through the center tappet 31, a lock pin 72 is embedded. The lock pin 72 is capable of plunging into the through hole 43*a* of the side tappet body 32*a* of the side tappet 32 under the pressurizing operation of the hydraulic plunger 71. Also, in the through hole 39, a return spring 73 is embedded. The return spring 73 biases the lock pin 72 towards the position where the center tappet 31 and the side tappet 32 are disconnected from each other and thus allowed to be displaced with respect to each other in the tappet-sliding direction.

The through hole 39 of the center tappet 39 is fitted with bushings 74, 75. The bushings 74, 75 are inserted into the opening portions in the edge faces 36*a*, 36*b* which confront the inner edge faces 40*a*, 40*b* of both the side tappets 32*a*, 32*b* of the side tappet 32, with the bushings 74, 75 being in alignment with the edge faces 36*a*, 36*b* of the center tappet 31. The bushing 75, fitted adjacent to hydraulic plunger 71, abuts a collar 76 formed on the periphery of the lock pin 72. With the abutment relationship between the bushing 75 and the collar 76, the lock pin 72 is restricted from displacement towards the hydraulic plunger 71. The bushing 74, fitted on the other side, maintains the return spring 73 in a compressed state between the bushing 74 and the collar 76 formed on the periphery of the lock pin 72.

In both through holes 43*a*, 43*b* of the side tappet 32, bushings 77, 78 are inserted, respectively. The bushing 78 is inserted in the through hole 43*b* of the side tappet body 32b in which the hydraulic plunger 71 is embedded. The bushing 78 is closed at its end portion on the tappet-periphery side by an end wall 78*a*, and comprises a fitting hole 78*b* slidingly fitted with the hydraulic plunger 71 at its inside portion. The bushing 77 is inserted in the through hole 43*a* of the side tappet body 32*a*. The bushing 77 includes a fitting hole 77*b* that receives an end portion of the lock pin 72 at its inside portion with respect to its axial direction, functioning as a stopper to restrict the lock pin 72 from being displaced. The bushings 77, 78, fitted in the side tappet 32, protrude from the through holes 43*a*, 43*b* so that their end portions, adjacent to the center tappet 31, confront the end faces of the bushings 74, 75 fitted in the through hole 39 of the center tappet 31, respectively, leaving predetermined clearances left therebetween.

The peripheral surface 41*a* of the side tappet body 32*a* fitted with the bushing 77 is vertically cut away, in part. The cutaway portion is provided at a portion on which the through hole 43*a* opens. To the cutaway portion, a guide member 87 is attached. The guide member 87 is rotatably supported by a pin 86 which is in turn supported by the bushing 77, so as to prevent the tappet 3 from turning in the circumferential direction. The guide member 87 has a semicolumnar shape with a semicircular cross-section and makes line contact with the groove 88. Accordingly, the guide member 87 can turn, guided by the groove 88 as the member 87 slides along the groove 88, so that the guide member 87 is always maintained in line contact with the groove 88. This provides less wear to the guide member 87 and/or the groove 88 than that caused by the guide member in a conventional sphere shape which would make point contact with a guide groove. Additionally, the bushing 77 is used for supporting the guide member 87, thereby simplifying the structure.

The center tappet 31 is also provided with engaging portions 89*a*, 89*b*. The engaging portions 89*a*, 89*b* protrude towards the inner edge faces 40*a*, 40*b* of both the side tappet bodies 32*a*, 32*b* of the side tappet 32 in the camshaft axial direction from a portion below the through hole 39 of both the edge faces 36*a*, 36*b* which confront both the side tappet bodies 32*a*, 32*b* of the side tappet 32. Thus, the engaging portions 89*a*, 89*b* are engagable with inwardly projecting ends of bushings 77, 78 fitted in the through holes 43*a*, 43*b* of both the side tappet bodies 32*a*, 32*b*. With the engagement (or the abutting relationship) between the engaging portions 89*a*, 89*b* and the bushings 77, 78 on both sides, the center tappet 31 is restricted from the upward displacement along the tappet sliding direction.

The lost-motion spring 35*a*, 35*b* biases the center tappet 31 so as to press the center tappet 31 onto the cam nose of the high-speed cam 21 or the bushings 77, 78. Thus, while the locking mechanism is in an unlock/unlocked state as described later, the center tappet 31 is pressed against the nose section of the high-speed cam 21, without rattling. In the case of no depression in the high-speed cam 21, the center tappet 31 may be pressed against the case circle portion of the high-speed cam 21 by the lost-motion spring 35*a*, 35*b*. However, in this embodiment with a depression (or no base circle) formed in the high-speed cam 21, the engagement (or abutting relationship) between the engaging portions 89*a*, 89*b* and the bushings 77, 78 limits the excessive upward displacement of the center tappet 31 so as to prohibit the top surface of the center tappet 31 from shifting beyond the top surfaces of the side tappets 32*a*, 32*b*, thereby avoiding the rattling of the center tappet 31. In addition, the limitation of the upward displacement of the center tappet 21 brings the through holes 39, 43*a*, and 43*b* into alignment with each other. This allows the lock pin 72 and the hydraulic plunger 71 to smoothly plunge into the through holes 39 and 43*a* when the lock mechanism comes into the lock state from the unlock state. Moreover, the abutting relationship between the engaging portions 89*a*, 89*b* and the bushings 77, 78 keeps the center tappet 31 from protruding upwardly against the bias of the lost-motion springs 35*a*, 35*b*, thereby allowing the tappet assembly 3 to be easily installed into the cylinder head. In assembling the tappet assembly 3, the bushing 77, 78 may protrude from the through hole 43*a*, 43*b* after the installation of the lost-motion springs 35*a*, 35*b*.

In this manner, a lock mechanism comprises the through holes 39, 43*a*, 43*b*, the hydraulic plunger 71, the lock pin 72, the return spring 73, and other components, which achieves the connection and disconnection between the center tappet 31 and the side tappet 32.

The lock mechanism is provided at the roughly central portion, and the lost-motion springs 35*a*, 35*b* are disposed at both sides of the rock mechanism such that the lock mechanism and the lost-motion springs 25*a*, 35*b* overlap with each other in the axial direction of the tappet. With this arrangement, relatively long coil springs can be used as the lose-motion springs to allow the center tappet 21 to displace over a longer distance downwardly with respect to the side tappets 32*a*, 32*b*. The longer the coil spring, the larger the difference between its free length and its solid height. Accordingly, in the case where the lift amount of the high-speed cam 21 is increased for more engine output and those of the low-speed cams 22, 23 are decreased to substantially zero with slight amount of lift, or in the case of the deactivating control of one of two intake valves, the difference in lift amount between the low-speed cams 22, 23 and the high-speed cam 21 can be enlarged by use of the relatively long springs to be compressed by a larger amount. The reason for not adopting the complete deactivation but leaving a slight amount of lift of several millimeters is that the intake airflow should be always formed. This airflow prevents the liquid fuel, having deposited in the intake port, from being drawn to the cylinder all at once in the following high-lift state. In a direct injection engine, the low-speed cams 22, 23 may be circular for complete deactivation because of no need for the airflow to be always formed.

The lock mechanism acts as will be described. The hydraulic plunger 71, in response to the application of hydraulic pressure, is displaced towards the lock pin 72, so that its end plunges into the through hole 39 of the center tappet 31 and moves the lock pin 72 against the biasing force of the return spring 73. This causes the end portion of the lock pin 72 to plunge into the through hole 43*a* of the side tappet body 32*a* of the side tappet 32. At this time, the hydraulic plunger 71 spans over the center tappet 31 and the side tappet body 32*b* of the side tappet 32, and the lock pin 72 spans over the center tappet 31 and the side tappet body

32*a* of the side tappet 32, which cooperatively interconnect the center tappet 31 with the side tappet 32 to achieve a lock state.

Upon the release of the hydraulic pressure, the return spring 73 pushes back the lock pin 72 towards the hydraulic plunger 71 to return the hydraulic plunger 71 up to its original position. At this time, both the end faces of the lock pin 72 in the through hole 30 of the center tappet 31 are brought into substantial alignment with separation surfaces defined between the center tappet 31 and side tappet 32, which disconnects the center tappet from the side tappet 32 to achieve an unlock state (release the lock).

In this manner, the lock mechanism selectively operates to achieve the lock state or the unlock state. During the lock state, the side tappet 32 and the center tappet 31 are interconnected with each other, so that the side tappet 32 and the center tappet 31 are driven together by the center cam 21, thereby lifting the valve in a high-speed mode. During the unlock state, the center tappet 31 is disconnected from the side tappet 32, so that the center tappet 31 freely moves while being pressed against the center cam 21 by the biasing force of the lost-motion springs 35*a*, 35*b*. As a result, the side cams 22, 23 drive the side tappet 32, thereby lifting the valve in a low-speed mode, or substantially deactivating the valve.

The tappet assembly 3 is provided with the guide member 87. The guide member 87 is attached to the cutaway portion over the through hole 43*a* of the peripheral surface 41 a of the side tappet body 32*a* fitted with the bushings 77 receiving the pin 86. The guide member 87 is in roughly rectangular and planar shape. An end of the pin 86 is inserted into the guide member 87 perpendicularly to the longitudinal direction of the guide member 87, and fixes the guide member 87 at a portion offset in the longitudinal direction of the guide member 87.

As shown in FIG. 2, in an inner surface of the tappet guide hole 4, the groove 88 is formed as described above. The groove 88 slidably engages with the guide member 87 held on the tappet assembly 3. Thus, the groove 88 allows the guide member 87 to move only in the tappet-sliding direction. The guide member 87 is attached in such a way that an upper length above the pin 86 is longer than a lower length below the pin 86 and thus its upper end is close to the cam-abutting face. With this structure, the guide member 87 restricts the tappet assembly 3 from turning, in conjunction with the groove 88 in the inner surface of the tappet guide hole 4.

The hydraulic pressure for operating the hydraulic plunger 71 of the lock mechanism is supplied from an oil pump (hydraulic pressure source), regulated by a hydraulic pressure control valve (not shown), and fed into an operating oil pressure chamber (not shown) located behind the hydraulic plunger 71 during the high-speed operation of the engine with the lock mechanism of the tappet assembly 3 being in the lock state. In order to achieve the hydraulic operation above, as shown in FIG. 1, the cam carrier 1 is formed with an oil gallery 91, from which an operating oil supply passage 93 branches off to open on the inner surface of the tappet guide hole 4. On the other hand, the side tappet body 32*b* of the side tappet 32 is formed with an oil passage 94 running up to the operating oil pressure chamber. The oil passage 94 is in fluid communication with the opening of the operating oil supply passage 93 in the inner surface of the tappet guide hole 4 while the side cam abutting faces of the side tappet 32 are in contact with the base circles of the side cams 22, 23. With this structure, oil pressure is supplied from the oil gallery 91 to the lock mechanism of the tappet assembly 3.

The oil pressure from the oil pump (hydraulic pressure source) is regulated by the hydraulic pressure control valve and introduced into the oil gallery 91. While the side cam abutting faces are in contact with the base circles of the side cams 22, 23 and thus the opening of the operating oil supply passage 93 in the inner surface of the tappet guide hole 4 is in fluid communication with the oil passage 94 in the tappet assembly 3, the hydraulic pressure is introduced into the oil passage 94 in the tappet assembly 3 through the operating oil supply passage 93, and then supplied into the operating oil pressure chamber behind the hydraulic plunger 71.

In accordance with the valve driving device for an engine of this embodiment, as described above, the high-speed center cam 21 is centrally located and flanked by low-speed side cams 22, 23 identical in cam profile, in the camshaft 2. The camshaft 2 is formed with a depression 21 a over a predetermined angle range where the cam nose section is not formed in the centrally located high-speed center cam 21. The depression 21*a* is depressed from the base circle of the center cam 21 so as to be smaller than the base circle of the low-speed side cams 22, 23 in profile and roughly the same as a shaft section of the center cam 21 in profile. Accordingly, molten metal smoothly fills between cams in a casting process for the camshaft 2, and the camshaft 2 is reduced in weight.

Additionally, the centrally located center cam 21 is formed with the depression 21*a* while the base circles of the outside side cams 22, 23 are free from the depression. This enables a tappet clearance to be easily adjusted by the measurement of the distance between a reference surface of the tappet assembly 3 and the base circle surface. More advantageously, the tappet clearance may be adjusted by the mechanical measurement of the distance between the base circle of the side cams 22, 23 and the upper surface of the guide member 87 as a reference surface. This is suitable for a production line.

In the above embodiment, the high-speed cam (center cam 21) is centrally located and flanked by the low-speed cams (side cams 22, 23) identical in cam profile, and the depression is formed in the high-speed cam. However, the present invention may be adopted to a valve driving device including a camshaft formed with cams arranged in reverse to the above in such a way that a low-speed cam is centrally located and flanked by high-speed cams. In this case, a depression may be formed in the centrally located low-speed cam.

It should be appreciated that the present invention may apply to an engine with a cylinder head integrating a can carrier although the above embodiment is described for an engine in which a cam carrier, separated in construction, is assembled to an upper portion of the cylinder head.

As apparent from the above description, a valve driving device for an engine according to the present invention, a camshaft is formed with a high-speed cam and a low-speed cam. In one of the high-speed cam and the low-speed cam, a cam portion over a predetermined angle range where a cam nose section is not formed is dimensioned so as to be smaller than a base circle of the other cam in profile. Accordingly, a lightweight camshaft is attained and improved metal flow is achieved in a casting process for the camshaft. Additionally, when the one cam is centrally located and flanked by the other cams, and when the depression which provides the small profile of the portion over the predetermined angle range is formed in the centrally located cam, a tappet clearance is easily adjusted by the measurement of the distance between a reference surface of the tappet and a base circle surface of the outside cams.

Although the present invention has been described in relation to particular embodiments thereof, many other variations and modifications and other uses will become apparent to those skilled in the art. It is preferred therefore, that the present invention be limited not by the specific disclosure herein, but only by the appended claims.

We claim:

1. A valve driving device for an engine comprising, a camshaft produced by casting and formed with one center cam and two side cams which are different from the center cam in lift amount, with the center cam being centrally located between the side cams in an axial direction of the camshaft, a tappet assembly slidably fitted in a tappet guide hole formed in the engine and abutting on one of the center cam and the side cams to drive a valve, and including a center tappet adapted to abut on the center cam and side tappets adapted to abut on the side cams, the center tappet being slidably connected to the side tappets in a sliding direction of the tappet, one of the center tappet and the side tappets being connected to a valve shaft of the valve, a lock mechanism which selectively locks or unlocks the center tappet and the side tappets with or from each other so that the tappet assembly is driven by the center cam when the lock mechanism locks the center tappet and the side tappets with each other and the tappet assembly is driven by the side cams when the lock mechanism unlocks the center tappet and the side tappets from each other, wherein one cam of the center cam and the side cams is dimensioned so that a cam portion thereof over a predetermined angle range except for a cam nose section thereof is smaller than a base circle of the other cam in profile.

2. The valve driving device for an engine as defined in claim 1, further comprising a depression formed over the predetermined angle range except for the cam nose section of the one cam, said depression being depressed from the base circle of the one cam so as to be substantially the same as a shaft section of the camshaft in profile.

3. The valve driving device for an engine as defined in claim 2, wherein the two side cams arc identical in cam profile and lower than the center cam in lift amount, and the one cam is the center cam.

4. The valve driving device for an engine as defined in any one of claims 1, wherein the portion over the predetermined angle range is left as-cast.

5. The valve driving device for an engine as defined in claim 1, further comprising a lost-motion spring biasing the center tappet towards the center cam in the tappet assembly, wherein the side tappet includes a limiting portion which limits the displacement of the center tappet against the biasing force of the lost-motion spring so as to prohibit an abutting surface of the center tappet on the center cam from shifting beyond abutting surfaces of the side tappets on the side cams.

6. The valve driving device for an engine as defined in claim 5, wherein the lock mechanism includes a hydraulic piston and a lock pin received in bushings fitted in through holes formed in the center tappet and the side tappets, the lock pin being driven by the hydraulic piston, wherein the bushing in the side tappet protrudes towards the center tappet so as to abut on the center tappet to limit the displacement of the center tappet.

7. The valve driving device for an engine as defined in claim 1, wherein the side tappets are connected with each other via a connecting portion provided at the ends opposite to the abutting surfaces to form substantially U-shape when viewed in a direction perpendicular to the sliding direction of the tappet and in the direction perpendicular to the axial direction of the camshaft, the connecting portion abuts on the valve shaft, and the tappet assembly is in substantially circle shape formed by the center tappet and the side tappet when viewed in the sliding direction of the tappet.

8. The valve driving device for an engine as defined in claim 7, wherein the center tappet is in substantially rectangular shape elongated in the direction perpendicular to the axial direction of the camshaft when viewed in the sliding direction of the tappet, projections are formed at both end surfaces of the center tappet with respect to the direction perpendicular to the axial direction of the camshaft and perpendicular to the sliding direction of the tappet, so as to project towards the side tappets, inner surfaces of the projections form sliding surfaces which extend in the sliding direction of the tappet and slidably contact with the side tappets, the side tappets are in substantially bicornate shape when viewed in the sliding direction of the tappet, and sliding surfaces are formed at both ends of the side tappets with respect to the direction perpendicular to the axial direction of the camshaft and perpendicular to the sliding direction of the tappet, so as to extend in the axial direction of the camshaft and in the sliding direction of the tappet and to slidably contact with the inner surfaces of the projections.

9. A valve driving device for an engine comprising, a camshaft produced by casting and formed with one center cam and two side cams which are lower than the center cam in lift amount and identical in cam profile, with the center cam being centrally located between the side cams in an axial direction of the camshaft, a tappet assembly slidably fitted in a tappet guide hole formed in the engine while abutting on one of the center cam and the side cams to drive a valve, and including a center tappet adapted to abut on the center cam and side tappets adapted to abut on the side cams, the tappet assembly being in substantially circle shape formed by the center tappet and the side tappets when viewed in the sliding direction of the tappet, the side tappets being connected with each other via a connecting portion provided at the ends opposite to abutting surfaces to form substantially U-shape when viewed in the direction perpendicular to the sliding direction of the tappet and in the direction perpendicular to the axial direction of the camshaft, the side tappet being coupled to a valve shaft of the valve at the connecting portion, the center tappet being slidably connected to the side tappets in a sliding direction of the tappet, a lock mechanism which selectively locks or unlocks the center tappet and the side tappets with or from each other so that the tappet assembly is driven by the center cam when the lock mechanism locks the center tappet and the side tappets with each other and the tappet assembly is driven by the side cams when the lock mechanism unlocks the center tappet and the side tappets from each other, wherein a depression is formed over a predetermined angle range except for a cam nose section of the center cam, said depression being depressed from a base circle of the center cam so as to be substantially the same as a shaft section of the camshaft in profile.

* * * * *